United States Patent [19]

Suzuki

[11] 4,225,117

[45] Sep. 30, 1980

[54] DEVICE FOR DETECTING CABLE BREAKS IN A LIFT

[75] Inventor: Yasunori Suzuki, Fujinomiya, Japan

[73] Assignee: Yasui Sangyo Co. Ltd., Fujinomiya, Japan

[21] Appl. No.: 957,716

[22] Filed: Nov. 6, 1978

[30] Foreign Application Priority Data

Dec. 10, 1977 [JP] Japan ..... 52-166337[U]

[51] Int. Cl.[3] ..... B66F 7/20

[52] U.S. Cl. ..... 254/89 H; 187/8.47

[58] Field of Search ..... 254/89 H, 89 R, 4 R, 254/4 B, 4 C, 47; 187/8.47

[56] References Cited

FOREIGN PATENT DOCUMENTS 724513 2/1955 United Kingdom ..... 187/8.47

*Primary Examiner*—Robert C. Watson

*Attorney, Agent, or Firm*—Michael A. Painter

[57] ABSTRACT

In a lift wherein a carriage is raised up a mast by at least one cable, a safety device is proposed which is attached to the mast and which comprises a push member, which is urged towards the cable so as to press sideways against it, so that if the cable slackens the push member moves sideways, and a safety switch, which is so positioned that when the cable becomes slack the push member in its movement sideways actuates the switch.

3 Claims, 4 Drawing Figures

DEVICE FOR DETECTING CABLE BREAKS IN A LIFT

The present invention relates to a safety device for a lift, and more particularly relates to a safety device for a lift in which a carriage is hoisted up and down a vertical mast by at least one cable which is attached to the carriage.

Many lifts have been proposed and practiced in which a carriage is moved up and down a mast. For example, two-masted lifts in which two pillars are provided, with a carriage moving up and down each of the masts, each of the carriages having two arms which extend inwards, and which support a vehicle from its opposite sides so as to lift it up when the carriages are raised, are widely known. Further, it is well-known to raise at least one of the carriages up its mast by a cable attached to the carriage. Also it is well-known to provide two cables of this kind running together in parallel for the sake of safety.

The dangers inherent in these lifts are also well-known. If the supporting cable or cables should break, a very serious accident is likely. For this reason various safety devices have been proposed for lifts. In a co-pending application for patent, U.S. Ser. No. 958,693 and now abandoned, filed by the same applicant and assigned to the same assignee as the present application, a device has been proposed which is attached to the carriage and which, when the cable which supports the carriage becomes slack, locks the carriage immediately to a smooth vertical rod, without allowing it to descend any substantial distance. Further, by its construction, if the carriage is supported by two cables in parallel, the invention proposed by the above-identified appliction will only operate when both the cables become slack, and therefore the carriage is otherwise unsupported.

This device is a great contribution to safety. However, it does not perfectly provide for the safety of a lift. Several problems still remain. In detail, first of all, if all support has failed for a carriage, and the device of the above-identified application has therefore locked the carriage to the smooth vertical rod, still a situation of a certain danger exists, and therefore it would be advisable to sound an alarm so that people who were working in a position to be endangered by the falling of a load supported by the lift should be able to get clear of the load. Secondly, in practice the breaking of a cable usually occurs when the carriage is being hoisted up or down the mast. In a two-pillar lift the two carriages are moved up and down their masts together, often by a single lifting means, the coupling together of the carriages often being performed by the cable. Therefore, if the cable breaks, if the lifting means is still in operation, there is a possibility that the other carriage may continue to be lifted up or lowered down its mast. This could again precipitate a vary serious accident. Therefore, it is desirable to de-activate the lifting means if a cable breaks. Thirdly, in a lift wherein the carriage is supported by two cables in parallel, if one only of the cables breaks, the lift can still be used, but of course great strain is placed upon the remaining cable, which may lead to its early failure, and may lead to distortion of other parts of the lift due to unbalanced forces occasioned by the broken cable being slack while the unbroken cable is being subjected to twice the normal stress.

Therefore, an object of the present invention is to provide a safety device in a lift which will promptly detect a break in a cable supporting a carriage.

Another object of the present invention is to provide a safety device in a lift wherein a carriage is hoisted up and down by two parallel cables which detects a break in one of the cables.

Another object of the present invention is to provide a safety device in a lift wherein a lifting means hoists a carriage up and down a mast which detects when one of the possibly plural cables which support the carriage is broken, and which then immobilizes the lifting means.

According to the present invention, these objects are accomplished by a safety device, in a lift comprising a vertical mast and a carriage which is hoisted up and down the mast by at least one cable which is attached to the carriage, comprising a push member, which is urged towards the cable so as to press sideways against it, so that if the cable slackens the push member moves sideways, and a safety switch, which is so positioned that when the cable becomes slack the push member, in its movement sideways, actuates the switch, said safety device being attached to the mast.

Other objects, features, and details of the present invention should become more clear from the following description of a preferred embodiment, taken together with the appended drawings. However, it should be clearly understood that the drawings and the embodiment are given for the purposes of illustration only, and that the scope of protection sought is not intended to be limited by any features shown in them, but only by the appended claims. In the drawings:

Figure 1:
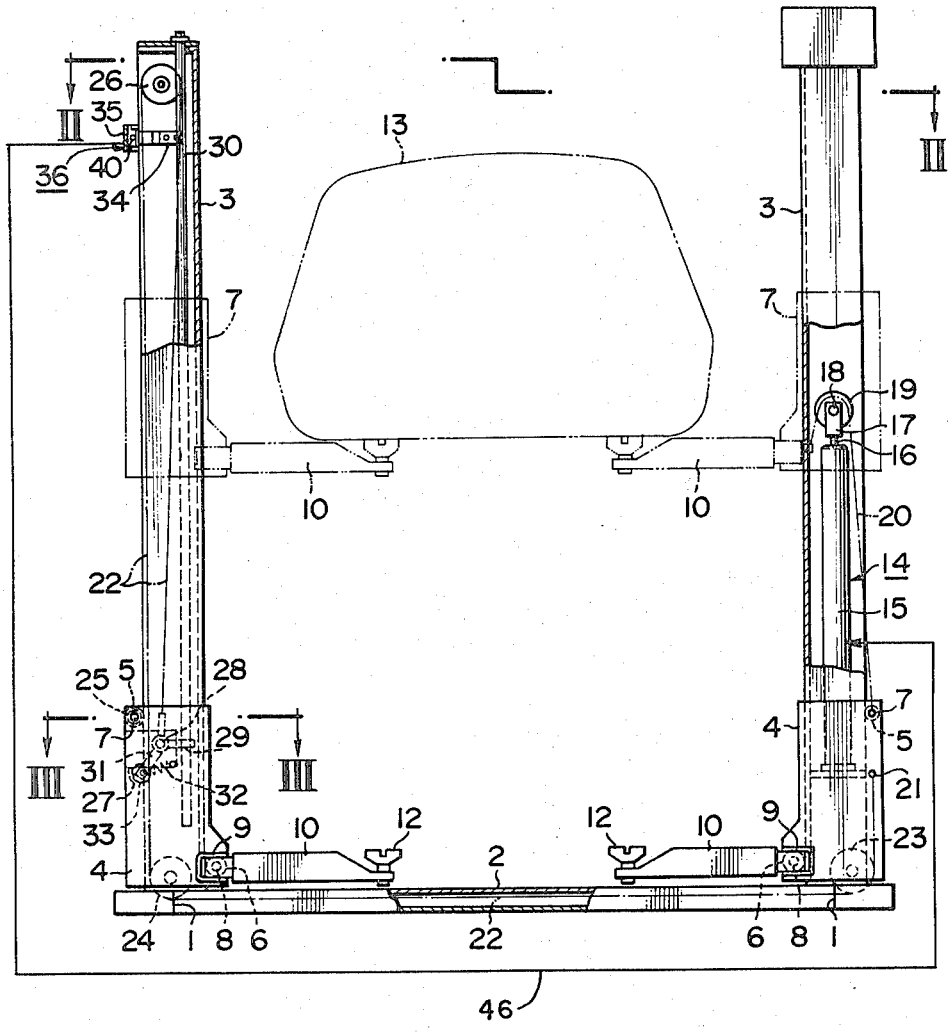
FIG. 1 is a front view, partly cut away, showing an example of a two-pillar lift fitted with the safety device of the present invention.

Referring to the drawings, a two pillar lift is shown therein which is fitted with a safety device according to the present invention. The particular two-pillar lift shown is of the sort wherein the carriage which is fitted with the safety device is supported by two cables in parallel. However this is not essential to the construction or operation of the present invention.

A hollow base 2 is provided at both left and right hand ends with legs 1 which extend to front and rear. On the base are mounted two support masts 3, one at the left and one at the right, whose horizontal cross-sections are outwards facing U-shapes. To each of these pillars is mounted slidably a carriage 4, also of a horizontal cross-section of outwards facing U-shape.

Within each carriage are mounted rollers 5 at an outer upper portion thereof, and rollers 6 at a lower inner portion. These rollers 5 and 6 are all similarly mounted rotatably on horizontal shafts 7 and 8 respectively, extending in the front to rear directions. By the rollers 5 and 6 rolling on the outer and inner surfaces of the pillars 3 the carriages easily and lightly slide up and down the pillars.

Figure 2:
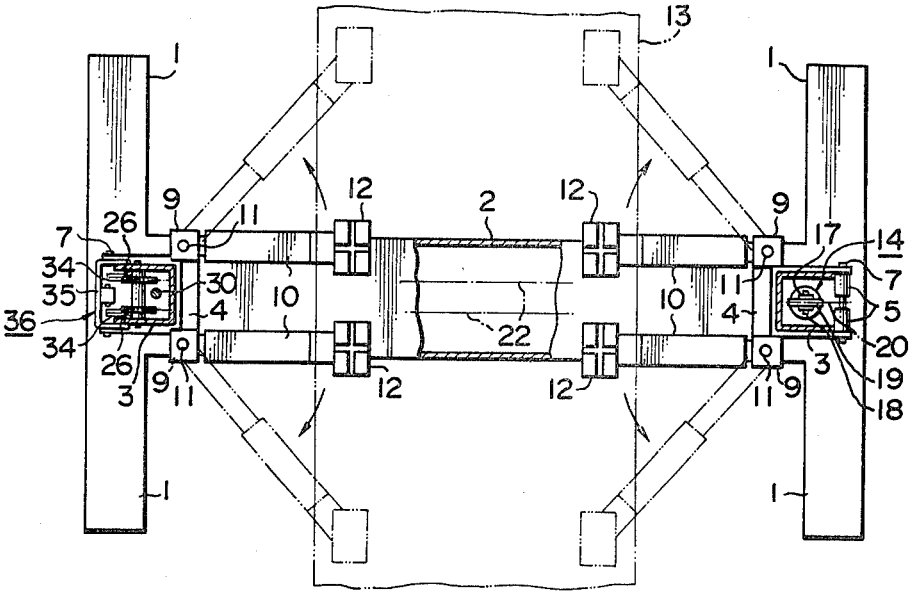
FIG. 2 is a horizontal cross-section along the line II—II in FIG. 1.

To front and rear sides of each carriage 4 are fixed brackets 9 whose vertical cross-sections are inward facing U-shapes. To these brackets are pivoted arms 10 which extend horizontally inwards and which are adapted to support an automobile, as diagrammatically illustrated in FIG. 2. The details of the construction of these arms are not relevant to the present invention.

In the embodiment of the present invention illustrated, the raising and lowering of the carriages 4 is carried out by a piston-cylinder type expansion device 14 within the right-hand pillar 3.

The piston of this expansion device 14 projects from the upper portion of a cylinder 15 and at the top of this piston 16 is fixed a fork-shaped trunnion. A pulley 19 is mounted rotatably on the trunnion by a horizontal shaft 18. A chain 20, one end of which is fixed to a point on the right hand pillar 3, somewhat below mid-height, and the other end of which is fixed to the middle of the shaft 7 supporting the roller 5 on the right-hand carriage 4, is passed over the pulley 19. Thus, as the piston 16 of the expansion device 14 moves in and out, through the medium of the chain 20 the carriage 4 is raised and lowered.

The left-hand carriage 4 is moved by being linked to the right hand carriage 4 by cables. Specifically, a pair of cables made of wire or the like, designated by 22, have their one ends attached to a shaft 21 mounted in the right hand carriage 4. Each of these cables then passes round a guide pulley 23 pivotally attached to the lower end of the right-hand pillar 3, through the inside of the base 2, around a guide pulley 24 pivotally attached to the lower end of the left hand pillar 3, up the inside of the left hand pillar 3, over a guide pulley 26 mounted at the top of the left hand pillar 3, and down to the left hand carriage 3, where it is attached thereto. It is easily seen that by these connecting cables 22 the left hand carriage is raised and lowered along its pillar to the same amount as the right hand carriage.

For the purposes of understanding of the present invention, it will suffice to say that the two cables 22 are affixed to the left hand carriage. The structure which can be seen in the figure in fact constitutes a safety device according to the previously-identified co-pending patent application, which is also fitted to the lift illustrated. The details are unnecessary for an understanding of the present invention; suffice it to say that, functionally, if the cables both break, so that the left-hand carriage is unsupported, then the device will immediately lock the carriage to the vertical rod 30 which can be seen as running parallel to the pillar 3, and thus the falling of the carriage will be prevented.

Figure 3:
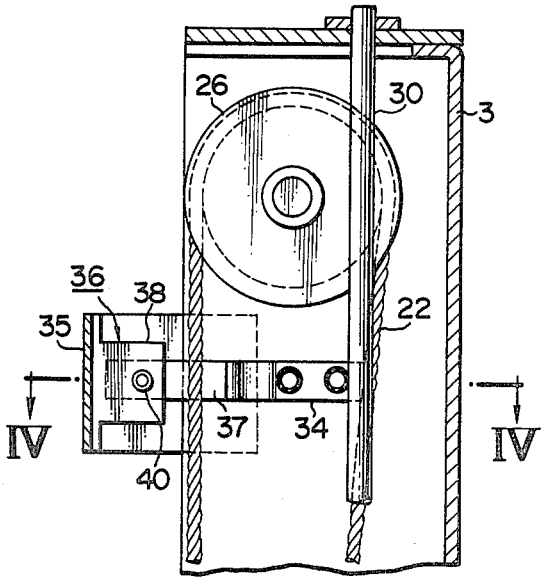
FIG. 3 is an enlarged vertical cross-section of the essential part of the present invention.
Figure 4:
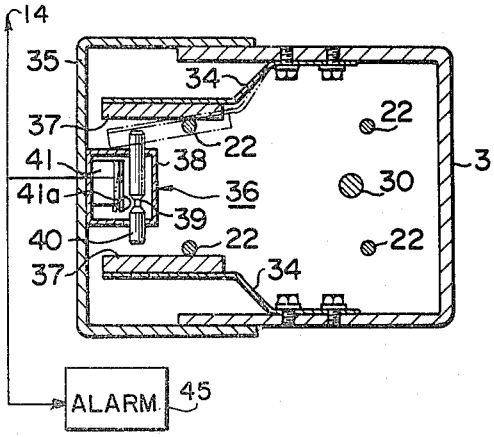
FIG. 4 is an enlarged horizontal cross-section along the line IV—IV in FIG. 3.

According to the present invention, near the top of the left hand pillar 3 is fitted a safety device, which detects a break in either of the cables 22. This device is best seen in FIGS. 3 and 4.

The device comprises two push members 34, of spring steel, which have their base ends fixed to the inside of the front and rear side members of the pillar 3, at a point somewhat below the guide pulleys 26, and which have their free ends extending outwards from the center of the lift, and urged inwards by their springy nature sideways against the cables 22. At the same height as these push members is a safety switch 36. This consists of a switch box 38, an activating rod 40 which slides therethrough, and a microswitch fixed within the switch box. The operating rod 40 passes through holes in the front and rear of the switch box 38 and its ends oppose the shoes 37, which are fixed on the free ends of the push members 34.

The activating rod 40 also has around it, at its central portion, a groove 39, and the activator 41*a* of the microswitch 41 engages in this groove, when the rod 40 is in the neutral position.

When both the cables 22 are taut, the two push members 34 bear against them, and are held away from the rod 40. Thus the activator 41*a* remains in the groove of the rod 40, and therefore the microswitch is not activated. However, if one of the cables 22 breaks, then it will become slack, and its push member will move inwards, and bear against the rod 40, as shown by a phantom line in FIG. 4. The activating rod 40 will then move along its axis, and thereby the microswitch will be operated.

By the operation of means which are not shown, the operation of this microswitch may be used to sound an alarm 45, and also and alternatively may be used to de-activate the piston-cylinder device 14 which is the driving means for raising and lowering the carriages schematically depicted by the reference numeral 46.

It is seen that according to the present invention a safety device is provided which is reliable, is cheap and easy to manufacture, and which detects breakage of either one of two cables which support the carriage. However, the present invention is not to be limited to the features of the described embodiment. For instance, a detecting device according to the present invention need not act on both of two cables which are fitted in parallel, but, as explained in the earlier portion of this specification, it can be of great use when fitted to a lift which has only one support cable. Further, although in the illustrated embodiment the push members are urged sideways towards the cable by their own spring force, this is not essential; other systems could be easily conceived of. For these reasons, it is clear that various changes and omissions of the form and the details of the embodiment of the invention can be made by one skilled in the art, without departing from its spirit. Therefore, it is desired that the scope of monopoly granted should not be limited by any details of the shown embodiment, or of the drawings, which have both been given for the purposes of illustration only, but only by the appended claims.

What is claimed is:

1. In a lift comprising a vertical mast and a carraige which is hoisted up and down the mast by at least one cable which is attached to the carriage, a safety device mounted to the mast, comprising:

(a) a push member comprising a spring metal member which is urged towards the cable so as to press sideways against it, whereby the push member moves sideways if the cable slackens; and (b) a safety switch comprising:

(i) an actuating rod which can slide to and fro, said actuating rod having an annular grove around the axis thereof, and (ii) a microswitch including an actuator which, in the non-actuated position, is in engagement with the annular groove of said activating rod, said actuating rod being positioned so that when the cable becomes slack the push member in its movement sideways actuates the switch

2. A lift comprising a safety device as in claim 1 wherein the activation of the safety switch sounds an alarm.

3. A lift comprising a safety device as in claim 1 wherein the activation of the safety switch deactivates a lifting means which moves the carriage up and down the mast.

* * * * *